US010208633B2

(12) United States Patent
Ahmed et al.

(10) Patent No.: US 10,208,633 B2
(45) Date of Patent: Feb. 19, 2019

(54) HYDRAULIC SUPPORT ELEMENT

(71) Applicant: Schaeffler Technologies AG & Co. KG, Herzogenaurach (DE)

(72) Inventors: Faheem Ahmed, Troy, MI (US); Colin Foster, Belle River (CA); David Chandler, Belle River (CA)

(73) Assignee: SCHAEFFLER TECHNOLOGIES AG & CO. KG, Herzogenaurach (DE)

( * ) Notice: Subject to any disclaimer, the term of this patent is extended or adjusted under 35 U.S.C. 154(b) by 10 days.

(21) Appl. No.: 15/477,176

(22) Filed: Apr. 3, 2017

(65) Prior Publication Data

US 2018/0283224 A1 Oct. 4, 2018

(51) Int. Cl.

| | |
|---|---|
| ***F01L 1/14*** | (2006.01) |
| ***F01L 1/24*** | (2006.01) |
| ***F01L 1/245*** | (2006.01) |
| *F01L 1/18* | (2006.01) |
| *F01L 13/00* | (2006.01) |

(52) U.S. Cl.

CPC ..... *F01L 1/2405* (2013.01); *F01L 1/245* (2013.01); *F01L 1/185* (2013.01); *F01L 1/24* (2013.01); *F01L 13/0005* (2013.01)

(58) Field of Classification Search

CPC ..... F01L 1/2405; F01L 1/245; F01L 1/185; F01L 1/24; F01L 13/0005

See application file for complete search history.

(56) References Cited

U.S. PATENT DOCUMENTS

| | | | | |
|---|---|---|---|---|
| 4,338,894 | A * | 7/1982 | Kodama | F01L 1/2405 123/90.43 |
| 4,584,976 | A | 4/1986 | Hillebrand | |
| 4,840,153 | A * | 6/1989 | Aida | F01L 1/2405 123/90.43 |
| 5,979,377 | A | 11/1999 | Barth et al. | |
| 7,644,693 | B2 | 1/2010 | Cecur | |
| 8,813,705 | B2 | 8/2014 | Christgen et al. | |
| 2005/0188938 | A1 | 9/2005 | Masello et al. | |
| 2008/0066704 | A1 * | 3/2008 | Cecur | F01L 1/24 123/90.52 |
| 2015/0369087 | A1 | 12/2015 | Nielsen et al. | |

* cited by examiner

*Primary Examiner* — Zelalem Eshete
(74) *Attorney, Agent, or Firm* — Matthew V. Evans

(57) ABSTRACT

A hydraulic support element including a housing with a central bore and a bottom face that is provided on one axial end of the housing, a piston that is arranged in the bore of the housing, the piston is connected to a bottom closure so as to define a first pressure chamber and a second pressure chamber is defined between the bottom face and the bottom closure. A valve is provided between the first pressure chamber and the second pressure chamber to regulate a fluid connection between the pressure chambers, and a seal formed between the piston and the bottom closure with the bottom closure being affixed to the piston in a detachable manner.

16 Claims, 7 Drawing Sheets

HYDRAULIC SUPPORT ELEMENT

FIELD OF INVENTION

The present invention relates to a hydraulic support element for a valve drive of an internal combustion engine, comprising a housing with a central bore and a piston that is provided in that bore, with the piston having a bottom to define a first pressure chamber and further comprising a second pressure chamber between a bottom face of the housing and the bottom of the piston, further comprising a valve that is provided between the first pressure chamber and the second pressure chamber.

BACKGROUND

Such a hydraulic support element is disclosed in the U.S. Pat. No. 8,813,705 B2. This Patent describes a hydraulic support element having a housing, a pressure piston, a high pressure chamber for a hydraulic pressure medium extending between a bottom face of the pressure piston and a bottom of the housing, wherein the housing includes a passage for the hydraulic pressure medium, which communicates radially inwardly with an aperture in the pressure piston, wherein the pressure piston includes a deflecting sheath for the hydraulic pressure medium, tightly contacting the pressure piston at the interior jacket axially below the aperture and extending to the proximity of a head of the pressure piston, wherein a rising line for the hydraulic pressure medium is formed between the deflecting sheath and the interior jacket, which starts at the aperture and leads in the area of the head into a reservoir inside the deflecting sheath directly in front of the return valve and with the deflecting sheath having at least one perforation axially above its contact.

SUMMARY

One object of the invention is to provide a hydraulic support element comprising a housing with a central bore and a bottom face that is provided on one axial end of the housing, a piston that is arranged in the bore of the housing, the piston is connected to a bottom closure so as to define a first pressure chamber and a second pressure chamber is defined between the bottom face and the bottom closure, a valve provided between the first pressure chamber and the second pressure chamber to regulate a fluid connection between the pressure chambers, and a seal formed between the piston and the bottom closure with the bottom closure being affixed to the piston in a detachable manner. Thus, the manufacturing of the piston is highly simplified and thus less expensive. The bottom closure can be manufactured separately from the piston. The design of the piston is also less complicated and thus easier to produce.

In another embodiment the piston comprises a first piston part and a second piston part and at least one of the piston parts is connected to the bottom closure. Preferably, the piston is a hollow cylindrical shape. This way, the piston has a less complex design and can be produced more easily and cheaply.

In another embodiment, the piston has a groove for the fixation of the bottom closure, and a retaining element is inserted in the groove. This way, the bottom closure is fixed to the piston in an axial direction. Preferably, the retaining element is ring-shaped and is snappable into the groove of the piston in order to fix the bottom closure.

In another embodiment, the second piston part includes a first portion and a second portion and the first portion has a smaller diameter than the second portion. This "chimney"-design of the piston increases a medium reserve volume in the first pressure chamber. Preferably, the second piston part further comprises at least one feed opening for a fluid connection. Preferably, the feed opening is located in an area between the first portion and the second portion of the second piston part.

In another embodiment, a pipe is integrated in the piston such that at least one part of the pipe is connected to at least one of the piston parts.

In another embodiment, the valve comprises a ball for opening and closing a fluid connection between the first pressure chamber and the second pressure chamber.

Preferably, the second piston part has at least one lubricant hole in a medial portion. It is preferred that the lubricant hole is in the first portion of the second piston part.

Additionally, in another embodiment, the second piston part is closed at one end face with a piston bottom. Preferably, the piston bottom further comprises a deaeration hole.

In another embodiment, the inner surface of the second piston part has a step formed by an increased inner diameter between the smallest inner diameter of the second piston part and the groove.

BRIEF DESCRIPTION OF THE DRAWINGS

The foregoing Summary and the following detailed description will be better understood when read in conjunction with the appended drawings, which illustrate a preferred embodiment of the invention. In the drawings.

DETAILED DESCRIPTION OF THE PREFERRED EMBODIMENTS

Figure 1:
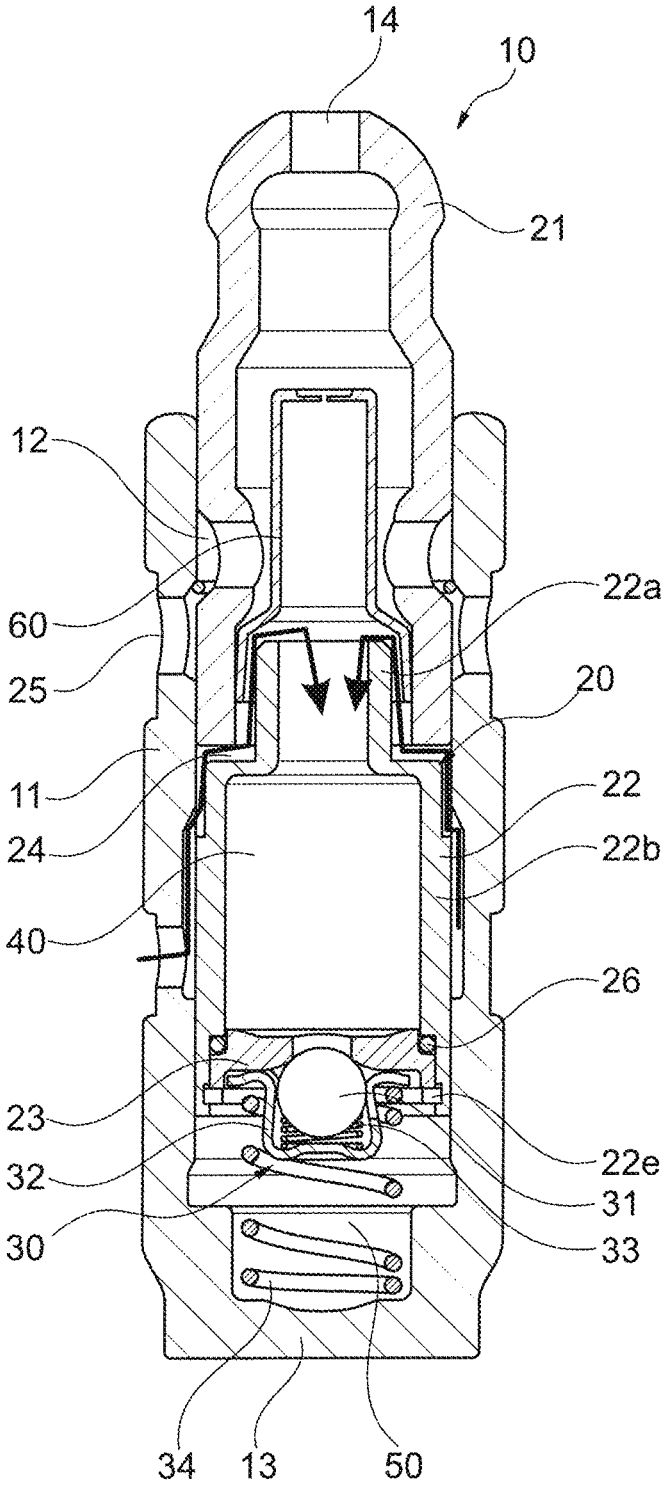
FIG. 1 is a longitudinal cross-sectional view through a hydraulic support element with a bottom closure that is affixed to a piston in a detachable manner.

Certain terminology is used in the following description for convenience only and is not limiting. The words "front," "rear," "upper" and "lower" designate directions in the drawings to which reference is made. The words "inwardly" and "outwardly" refer to directions toward and away from the parts referenced in the drawings. "Axially" refers to a direction along the axis of a shaft. A reference to a list of items that are cited as "at least one of a, b, or c" (where a, b, and c represent the items being listed) means any single one of the items a, b, or c, or combinations thereof. The terminology includes the words specifically noted above, derivatives thereof and words of similar import.

Hydraulic support element 10 is shown in FIG. 1 for a valve drive of an internal combustion engine. It includes a pot-shaped housing 11 with a central bore 12 and a bottom face 13. The bottom face 13 closes the housing 11 of the hydraulic support element 10 on one axial end. The bottom face 13 can be designed as a separate part, that is connected to the housing 11 or as an integrated part, so that the housing 11 and the bottom face 13 are a one-piece part. A piston 20 is located in the bore 12 of the housing 11. The piston 20 is of a cylindrical shape, especially of a hollow cylindrical shape. Preferably, the piston includes a first piston part 21 and a second piston part 22, that are connectable with each other. The housing 11 has at least one feed opening 25 for hydraulic medium to allow a communication with the inner side of the piston 20.

Figure 1A:
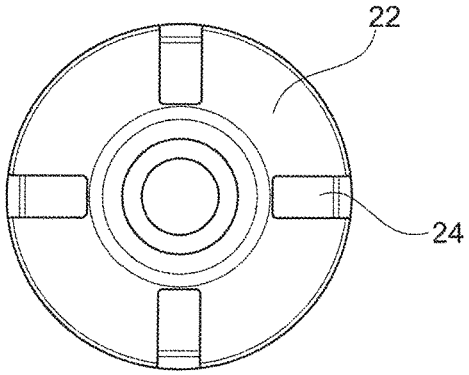
FIG. 1A is a top view of a second piston part shown in FIG. 1.

The second piston part 22 has a first portion 22*a* and a second portion 22*b*, whereby the second portion 22*b* has a greater diameter than the first portion 22*a*. Both portions 22*a*, 22*b* are, preferably integrally, connected to each other by a shoulder. This shoulder provides at least one feed opening 24 to allow a flow of hydraulic medium from the outside of the hydraulic support element 10 to the inner side of the piston 20. Preferably, there are provided more than one, especially four feed openings 24 in the area between the first and the second portion 22*a*, 22*b* of the second piston part 22, as shown in FIG. 1A. Preferably, the feed openings 24 are formed by slots distributed evenly about the circumference of the shoulder of the piston part. The first piston part 21 is in contact with the second piston part 22 with its face end in the shoulder area defined above. The first portion 22*a* of the second piston part 22 is located radially within one end of the first piston part 21, whereby both piston parts 21, 22 overlap in this area. Radially between the first portion 22*a* of the second piston part 22 and the end part of the first piston part 21 that radially overlaps with the first portion 22*a*, there is provided a pipe 60 that extends into the inner side of the first piston part 21 to increase the volume defined in a first pressure chamber 40. The first pressure chamber 40 is located within the piston 20. The pipe 60 is open on both end faces.

On the other side of the second piston part 22 there is provided a bottom closure 23. In a preferred embodiment, the bottom closure 23 is ring-shaped and has a central opening. The bottom closure 23 is affixed to the piston 20 in a detachable manner. This allows to manufacture the piston 20, especially the second piston part 22, with a very simple process and thus cost-effective.

For the fixation of the bottom closure 23 to the piston 20 there is provided a step on the inner diameter of the second piston part 22. This step has an increased diameter in comparison to the medial portion of the second piston, part 22. To prevent leakage there is assembled a seal 26, especially in form of an o-ring, to the step of the inner side of the second piston part 22. After that, the bottom closure 23 is assembled and is affixed with a retaining element 27. This retaining element 27 is preferably ring-shaped and is snappable to the inner side of the second piston part 22 in a groove 22*e*. The retaining element 27 is in direct contact with the bottom closure 23 and secures it in an axial direction. The step and the seal 26 on the other axial side of the bottom closure 23 define a second limit stop for the bottom closure 23. Thus, it is securely fixed to the piston 20.

The seal 26 seals the first pressure chamber 40 that is defined with the inner volume of the piston 20, from a second pressure chamber 50. The second pressure chamber is defined between the bottom closure 23 and the bottom face 13 of the housing 11.

The hydraulic support element further comprises a valve 30 including an axial movable ball 31 for the opening and closing of a fluid connection between the first and the second pressure chamber 40, 50. Therefore, the valve further comprises a pot-shaped cap 32. Within the cap 32 there is provided a spring 33 that urges the ball 31 against the bottom closure 23 to open and/or close the central opening of the bottom closure 23 and thus allow a fluid connection between the first and second pressure chamber 40, 50. The cap 32 is held in position between the bottom closure 23 and the retaining element 27 due to the connection between the retaining ring 27 and the piston 20. On the outer side of the cap 32, there is further provided a return spring 34 that urges the cap 32 towards the bottom closure 23.

Preferably, the pressure in the first pressure chamber 40 is lower than the pressure in the second pressure chamber 50. Thus, the valve ball 31 is normally in direct contact with the bottom closure 23 (and closes the central opening of the bottom closure 23). The valve 30 is therefore normally closed.

FIG. 1A shows the second piston part 22 in a top view. The feed openings 24 for the medium communication to the first pressure chamber 40 are shown. The feed openings 24 are designed as L-shaped slots in the shoulder area between the first portion 22*a* and the second portion 22*b* of the second piston part 22. Thus, the feed openings 24 are provided in the surface of the first and the second portion 22*a*, 22*b*.

Figure 1B:
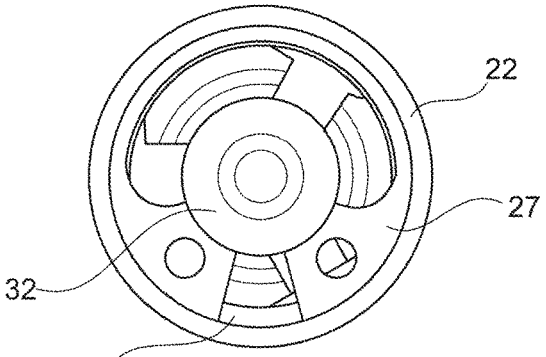
FIG. 1B is a bottom view of the second piston part shown in FIG. 1.

FIG. 1B shows the second piston part 22 from a bottom view. The retaining element 27 is connected to the second piston part 22, especially by a snap-connection. The retaining element 27 has an opening on its outer ring as to allow it to reduce its diameter during the assembly into the groove 22*e* of the second piston part 22. The cap 32 has a rim that is provided axially between the bottom closure 23 and the retaining element 27. In the rim of the cap 32 there are provided openings for a better fluid connection between the first pressure chamber 40 and the second pressure chamber 50.

Figure 1C:
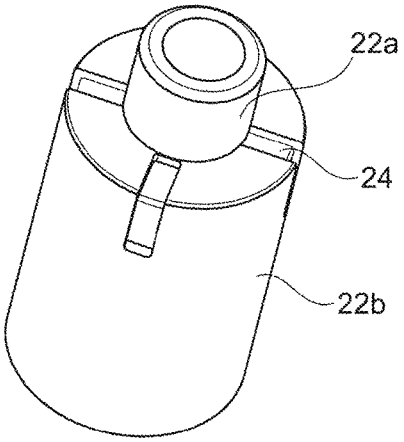
FIG. 1C is an isometric view of the second piston part shown in FIG. 1.

FIG. 1C shows an isometric view of the second piston part 22 shown in FIG. 1, having the first portion 22*a* and the second portion 22*b* with the feed openings 24. The feed openings 24 extend from the front side of the second portion 22*b* to the lateral surface of the second piston part 22 and are provided uniformly over the circumference of the front side of the second portion 22*b*.

Figure 2:
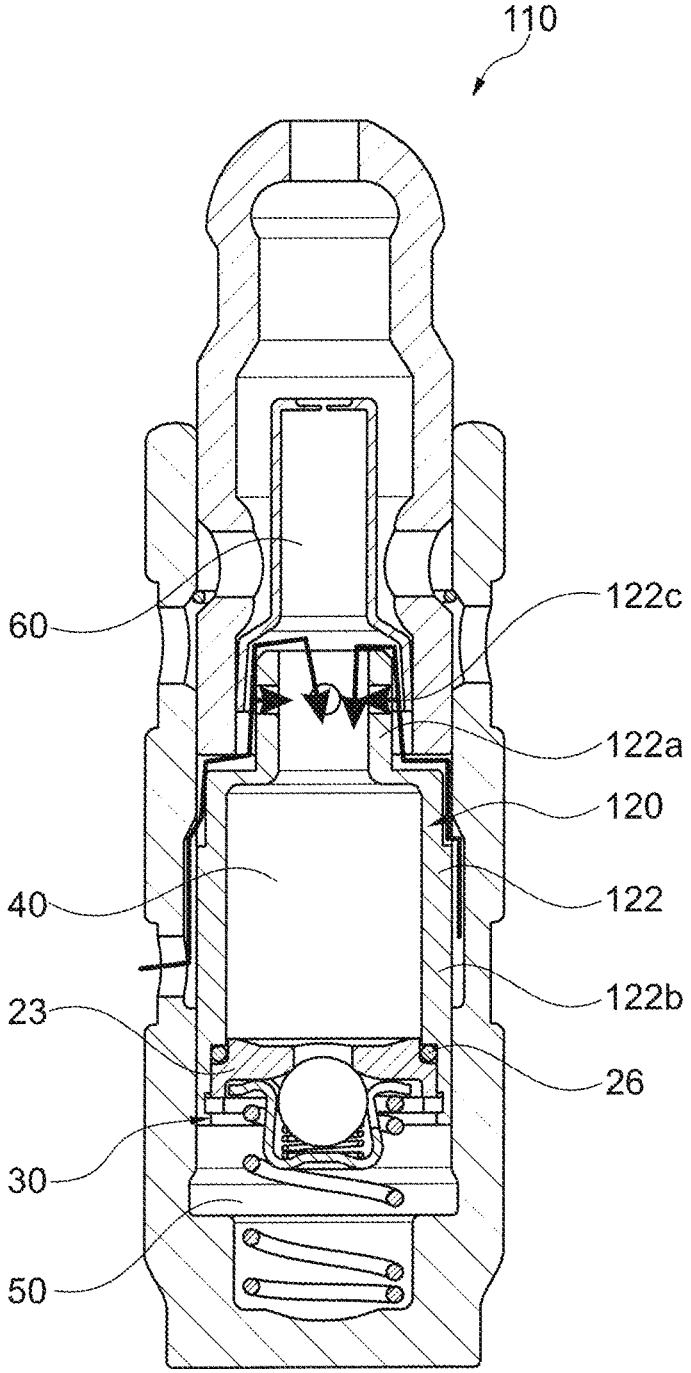
FIG. 2 is a longitudinal cross-sectional view through a hydraulic support element according to a second embodiment.

FIG. 2 shows another embodiment of the hydraulic support element 110. The basic design of the hydraulic support element 10 is identical with the support element 110 shown in FIG. 1, and accordingly only the differences will be described in detail. The hydraulic support element 110 in FIG. 2 has medium/lubricant holes 122*c* in the first portion 122*a* of the second piston part 122 in order to promote medium flow, especially oil flow. Preferably, there is at least one lubricant hole 122*c* in the second piston part 122, especially there are four lubricant holes 122*c* evenly distributed around the first portion 122*a* of the second piston part 122.

Figure 3:
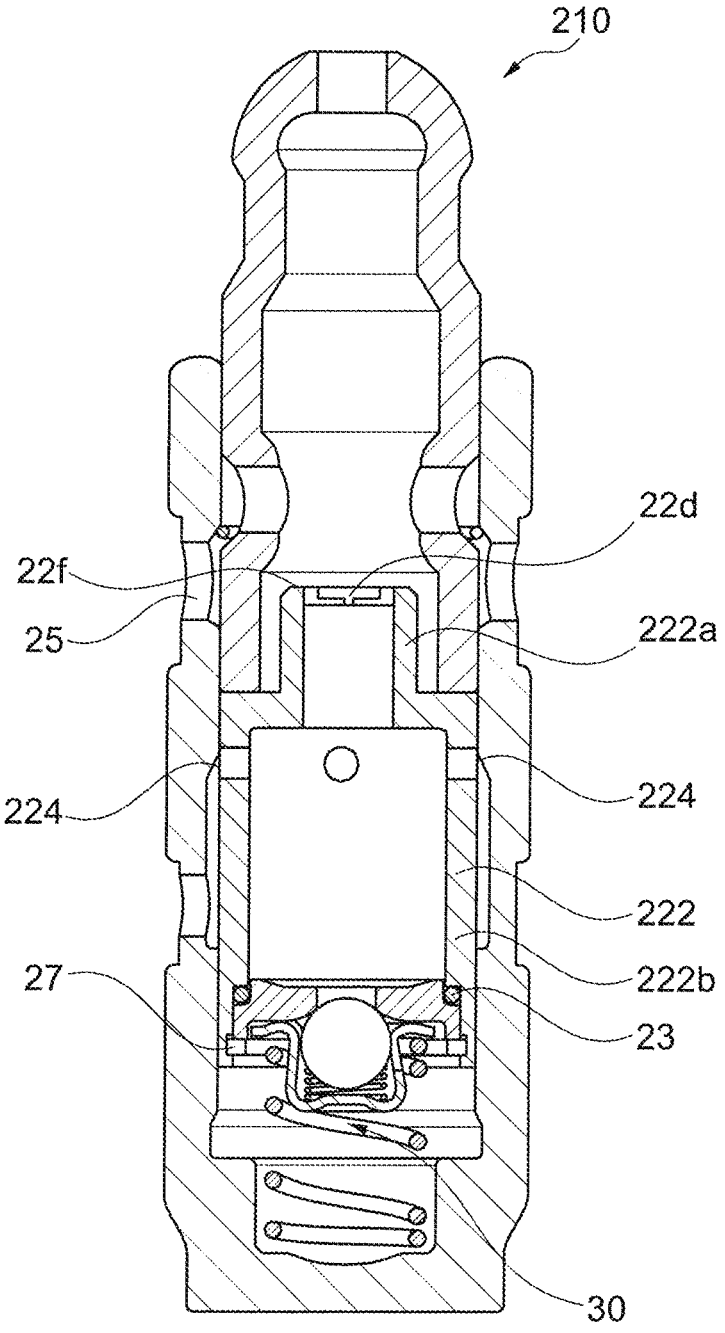
FIG. 3 is a longitudinal cross-sectional view through a hydraulic support element according to a third embodiment.

FIG. 3 shows a third embodiment of the hydraulic support element 210. The basic design of the hydraulic support element 210 is similar to the support elements 10, 110 shown in FIGS. 1 and 2. In this embodiment the second piston part 222 has a first portion 222*a* that is closed at one end 22*f*, which is preferably the top of the stamped or pressed second piston part 222. In that piston top 22*f* there is provided a deaeration hole 22*d*. The dearation hole 22*d* has a varying diameter throughout the thickness of the piston top 22*f*. The piston top 22*f* separates the pressure chamber 40 for the hydraulic lash adjustment medium and the medium for the switching function at the top. For the medium communication, there are provided feed openings 224 in the side area of the second portion 222*b* of the second piston part 222.

Figure 4:
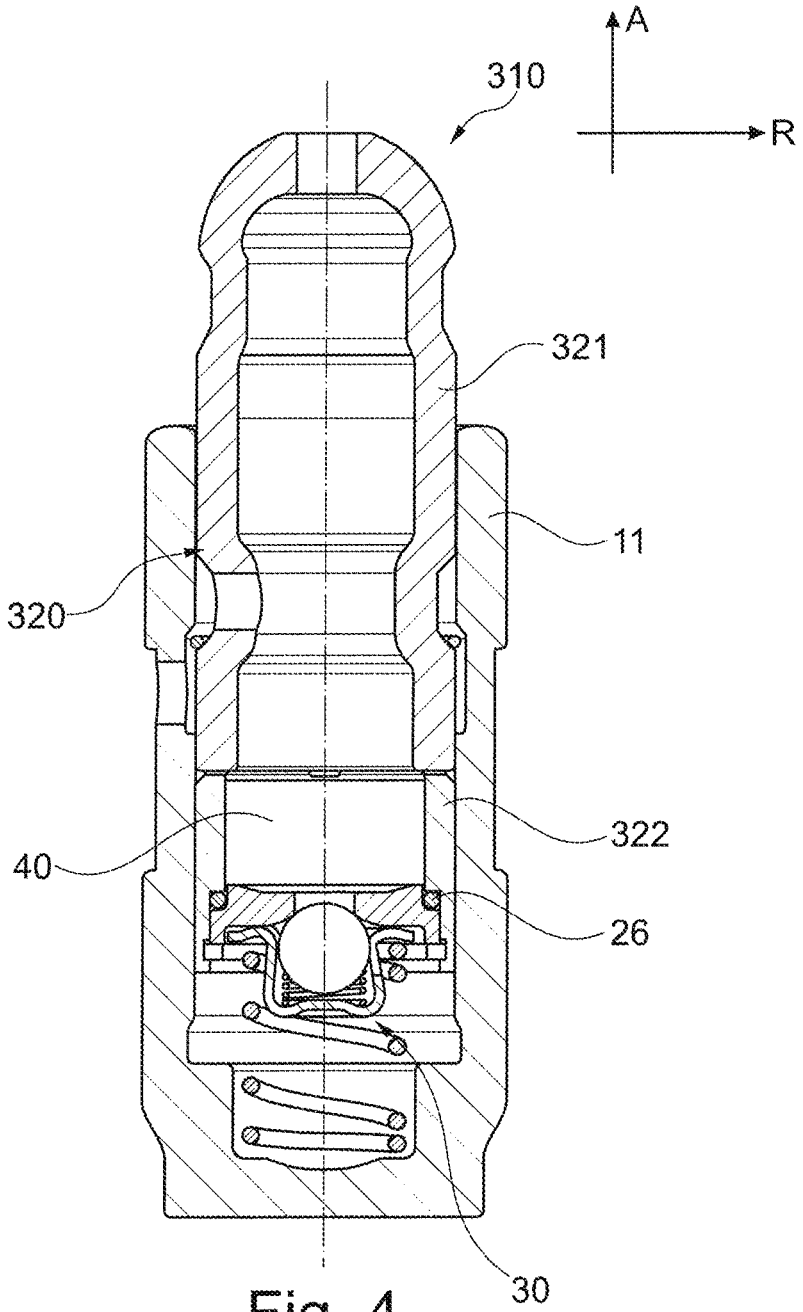
FIG. 4 is a longitudinal cross-sectional view through a hydraulic support element according to fourth embodiment.

FIG. 4 shows the hydraulic support element 310 in a fourth embodiment. The piston 320 in the housing 11 is formed of the first piston part 321 and the second piston part 322. The second piston part 322 is of a hollow cylindrical shape without a reduction in its inner diameter. The second piston part 322 has a through bore with a step for the positioning of the seal 26 and another step for the securing of the retaining element 27. The second piston part 322 is connected to the first piston part 321 on its top front side.

Figure 5:
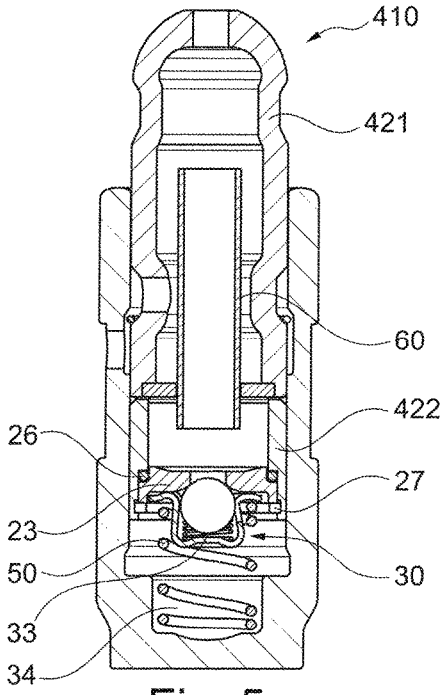
FIG. 5 is a longitudinal cross-sectional view through a hydraulic support element according to a fifth embodiment.

FIG. 5 shows another embodiment of the hydraulic support element 410 with a second piston part 422 that has a hollow cylindrical shape that is partly closed at one end so as to provide an opening to the first piston part 421. In this embodiment, the pipe 60 is provided in the opening of the second piston part 422. The pipe 60 is press-fitted into the second piston part 422 and provides an extra volume reservoir.

Figure 5A:
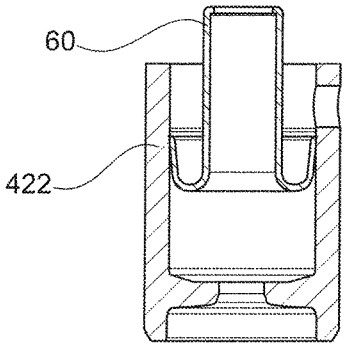
FIG. 5A shows a first pipe design.
Figure 5B:
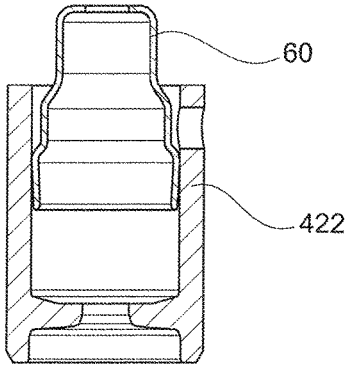
FIG. 5B shows a second pipe design.

FIG. 5A shows a possible embodiment for the pipe 60 with a u-shaped part that is inserted into the second piston part 422. FIG. 5B shows another embodiment for the pipe 60 with the pipe having a press-fit connection to the inner diameter of the second piston part 422.

Figure 6:
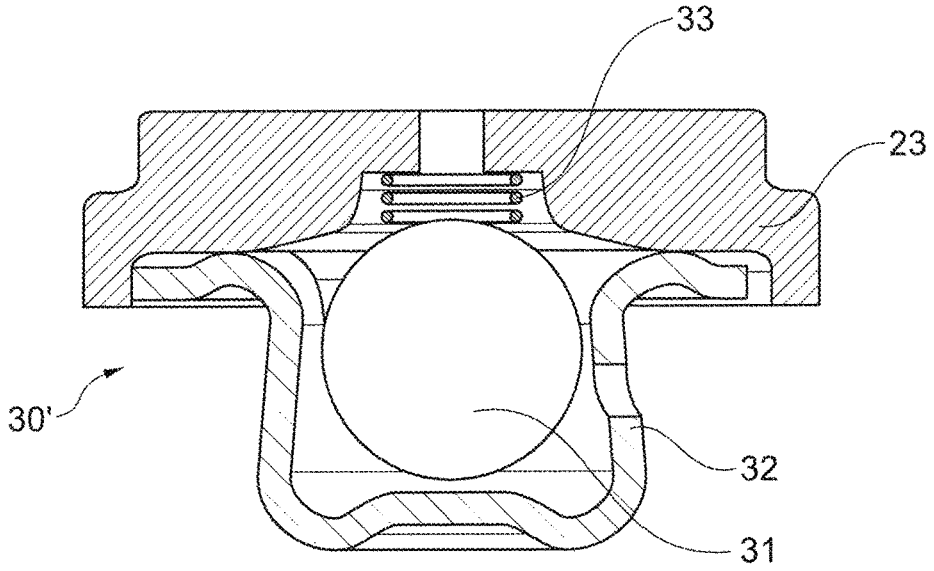
FIG. 6 shows a valve of a hydraulic support element in a cross-sectional view in a normally open embodiment.

FIG. 6 shows another embodiment of the valve 30' in a normally open variant. Therefore, it is provided a spring 33 on the bottom closure 23 with the spring 33 having a preload towards the ball 31. This kind of valve 30 can be combined with every embodiment of the hydraulic support element 10, 110, 210, 310, 410 shown in this application.

Having thus described the present invention in detail, it is to be appreciated and will be apparent to those skilled in the art that many physical changes, only a few of which are exemplified in the detailed description of the invention, could be made without altering the inventive concepts and principles embodied therein. It is also to be appreciated that numerous embodiments incorporating only part of the preferred embodiment are possible which do not alter, with respect to those parts, the inventive concepts and principles embodied therein. The present embodiment and optional configurations are therefore to be considered in all respects as exemplary and/or illustrative and not restrictive, the scope of the invention being indicated by the appended claims rather than by the foregoing description, and all alternate embodiments and changes to this embodiment which come within the meaning and range of equivalency of said claims are therefore to be embraced therein.

LIST OF REFERENCE NUMERALS

10, 110, 210, 310, 410 hydraulic support element
11 housing
12 bore
13 bottom face
14 opening
20, 120, 220, 320 piston
21 first piston part
22, 122, 222, 322 second piston part
22*a*, 122*a*, 222*a*, 322*a* first portion
22*b*, 122*b*, 222*b*, 322*b* second portion
22*c*, 122*c*, 222*c*, 322*c* lubricant hole
22*d* deaeration hole
22*e* groove
22*f* piston top
23 bottom closure
24, 224 feed opening
25 feed opening
26 seal
27 retaining element
30, 30' valve
31 ball
32 cap
33 spring
34 return spring
40 first pressure chamber
50 second pressure chamber
60 pipe

What is claimed is:

1. A hydraulic support element comprising:

a housing with a central bore and a bottom face that is provided on one axial end of the housing;

a piston that is arranged in the bore of the housing, the piston is connected to a bottom closure so as to define a first pressure chamber, and a second pressure chamber is defined between the bottom face and the bottom closure;

a valve provided between the first pressure chamber and the second pressure chamber to regulate a fluid connection between the pressure chambers; and a seal formed between the piston and the bottom closure with the bottom closure being affixed to the piston in a detachable manner.

2. The hydraulic support element as recited in claim 1, wherein the piston comprises a first piston part and a second piston part, and at least one of the piston parts is connected to the bottom closure.

3. The hydraulic support element as recited in claim 1, wherein the piston has a hollow cylindrical shape.

4. The hydraulic support element as recited in claim 1, wherein the piston, has a groove for fixation of the bottom closure, and a retaining element is inserted in the groove.

5. The hydraulic support element as recited in claim 4, wherein the retaining element is ring-shaped and is snappable into the groove of the piston in order to fix the bottom closure.

6. The hydraulic support element as recited in claim 2, wherein the second piston part includes a first portion and a second portion and the first portion has a smaller diameter than the second portion.

7. The hydraulic support element as recited in claim 6, further comprising at least one feed opening in the second piston part for a fluid connection.

8. The hydraulic support element as recited in claim 7, wherein the feed opening is located in an area between the first portion and the second portion of the second piston part.

9. The hydraulic support element as recited in claim 2, wherein a pipe is integrated in the piston such that at least one part of the pipe is connected to at least one of the piston parts.

10. The hydraulic support element as recited in claim 1, wherein the valve comprises a ball for opening and closing a fluid connection between the first pressure chamber and the second pressure chamber.

11. The hydraulic support element as recited in claim 6, wherein the second piston part has as least one lubricant hole in a medial portion.

12. The hydraulic support element as recited in claim 11, wherein the lubricant hole is in the first portion of the second piston part.

13. The hydraulic support element as recited in claim 6, wherein the second piston part is closed at one end face with a piston top.

14. The hydraulic support element as recited in claim 13, further comprising a deaeration hole in the piston top.

15. The hydraulic support element as recited in claim 4, wherein the inner surface of the second piston part has a step formed by an increased inner diameter between a smallest inner diameter of the second piston part and the groove.

16. The hydraulic support element as recited in claim 10, wherein a spring urges the ball of the valve toward an open or closed position of the valve.

* * * * *